United States Patent [19]

Horton

[11] Patent Number: 4,572,581

[45] Date of Patent: Feb. 25, 1986

[54] IN-SITU RECOVERY OF MINERAL VALUES

[75] Inventor: Robert L. Horton, South Russell, Ohio

[73] Assignee: Phillips Petroleum Company, Bartlesville, Okla.

[21] Appl. No.: 492,279

[22] Filed: May 6, 1983

[51] Int. Cl.[4] ..... E21C 41/14

[52] U.S. Cl. ..... 299/4; 299/5; 423/17; 423/18

[58] Field of Search ..... 299/4, 5; 75/101 R, 75/121; 423/18, 20, 139

[56] References Cited

U.S. PATENT DOCUMENTS

| | | | |
|---|---|---|---|
| 565,342 | 8/1896 | Frasch | 299/4 |
| 3,278,233 | 10/1966 | Hurd et al. | 75/101 R |
| 3,511,645 | 5/1970 | Goni | 75/101 |
| 3,882,018 | 5/1975 | Depree | 423/139 |
| 4,105,253 | 8/1978 | Showalter | 299/4 |
| 4,155,982 | 5/1979 | Hankin et al. | 423/7 |
| 4,243,638 | 1/1981 | Jackovitz et al. | 423/17 |
| 4,291,920 | 9/1981 | Lingane et al. | 299/4 |
| 4,376,098 | 3/1983 | Yan | 299/4 X |

*Primary Examiner*—Stephen J. Novosad
*Assistant Examiner*—Bruce M. Kisliuk
*Attorney, Agent, or Firm*—C. F. Steininger

[57] ABSTRACT

Mineral values, particularly uranium, are recovered from subsurface earth formations containing the same, as well as cations which form precipitates with sulfuric acid leach solutions, by injecting into at least one injection well a preliminary acidic solution capable of forming soluble materials with at least one of the precipitate-forming cations, such as calcium and iron cations, passing the preliminary acidic solution through the subsurface formation for a time sufficient to form such soluble materials, withdrawing the preliminary acidic solution containing the solubilized materials from at least one producing well, thereafter, injecting a sulfuric acid leach solution into said injection well, contacting the subsurface formation with the leach solution for a time sufficient to extract significant amounts of mineral values from the formation and produce a pregnant leach solution containing the thus solubilized mineral values and withdrawing the pregnant leach solution from the production well. In a preferred aspect, the preliminary acidic solution capable of forming soluble materials from precipitate-forming cations is selected from the group consisting of solutions of acetic acid, hydrochloric acid, citric acid, mixtures thereof, one or more of the same in sequence and one or more of the same and mixtures thereof in combination with sulfuric acid.

4 Claims, 1 Drawing Figure

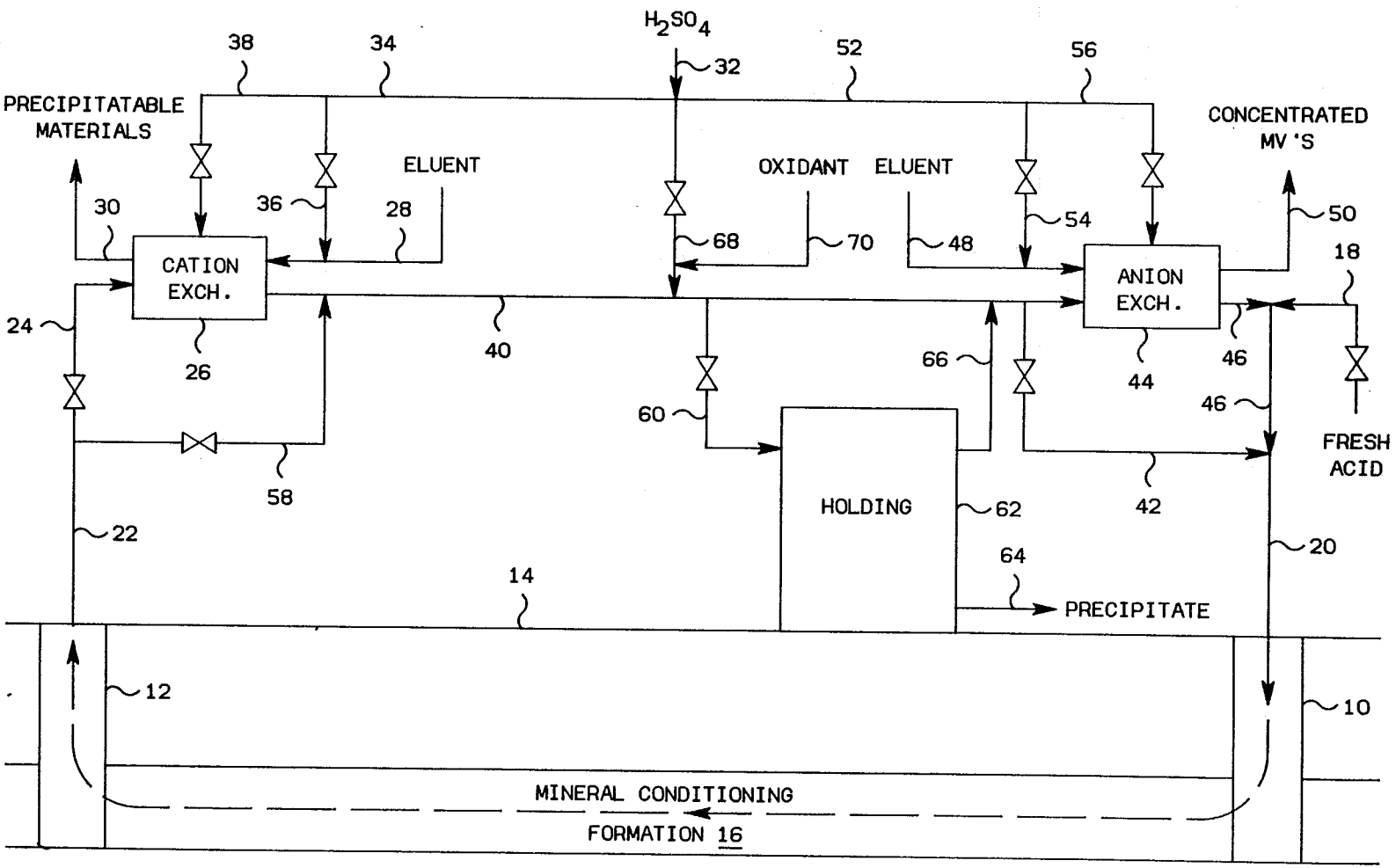
CONCENTRATED MV'S
FRESH ACID
ANION EXCH.
PRECIPITATE
HOLDING
ELUENT
OXIDANT
$H_2SO_4$
MINERAL CONDITIONING FORMATION 16
ELUENT
CATION EXCH.
PRECIPITATABLE MATERIALS
10
12
14
18
20
22
24
26
28
30
32
34
36
38
40
42
44
46
48
50
52
54
56
58
60
62
64
66
68
70

IN-SITU RECOVERY OF MINERAL VALUES

The present invention relates to the in-situ recovery of mineral values from subsurface earth formations containing the same. More particularly, the present invention relates to the in-situ recovery of mineral values from subsurface formations containing the same by extraction with sulfuric acid leach solutions.

BACKGROUND OF THE INVENTION

Numerous minerals are present in subsurface earth formations in very small quantities which make their recovery extremely difficult. However, in most instances, these minerals are also extremely valuable, thereby justifying efforts to recover the same. An example of one such mineral is uranium. However, numerous other valuable minerals, such as copper, nickel, molybdenum, rhenium, silver, selenium, vanadium, thorium, gold, rare earth metals, etc., are also present is small quantities in some subsurface formations, alone and quite often associated with uranium. Consequently, the recovery of such minerals is fraught with essentially the same problems as the recovery of uranium and, in general, the same techniques for recovering uranium can also be utilized to recover such other mineral values, whether associated with uranium or occurring alone. Therefore, a discussion of the recovery of uranium will be appropriate for all such minerals.

Uranium occurs in a wide variety of subterranean strata such as granites and granitic deposits, pegmatites and pegmatite dikes and veins, and sedimentary strata such as sandstones, unconsolidated sands, limestones, etc. However, very few subterranean deposits have a high concentration of uranium. For example, most uranium-containing deposits contain from about 0.01 to 1 weight percent uranium, expressed as $U_3O_8$ as is conventional practice in the art. Few ores contain more than about 1 percent uranium and deposits containing below about 0.1 percent uranium are considered so poor as to be currently uneconomical to recover unless other mineral values, such as vanadium, gold and the like, can be simultaneously recovered.

There are several known techniques for extracting uranium values from uranium-containing materials. One common technique is roasting of the ore, usually in the presence of a combustion supporting gas, such as air or oxygen, and recovering the uranium from the resultant ash. However, the present invention is directed to the extraction of uranium values by the utilization of aqueous leaching solutions. There are two common leaching techniques for recovering uranium values, which depend primarily upon the accessibility and size of the subterranean deposit. To the extent that the deposit containing the uranium is accessible by conventional mining means and is of sufficient size to economically justify conventional mining, the ore is mined, ground to increase the contact area between the uranium values in the ore and the leach solution, usually less than about 14 mesh but in some cases, such as limestones, to nominally less than 325 mesh, and contacted with an aqueous leach solution for a time sufficient to obtain maximum extraction of the uranium values. On the other hand, where the uranium-containing deposit is inaccessible or is too small to justify conventional mining, the aqueous leach solution is injected into the subsurface formation through at least one injection well penetrating the deposit, maintained in contact with the uranium-containing deposit for a time sufficient to extract the uranium values and the leach solution containing the uranium, usually referred to as a "pregnant" solution, is produced through at least one production well pentrating the deposit. It is the latter in-situ leaching of subsurface formations to which the present invention is directed.

The most common aqueous leach solutions are either aqueous acidic solutions, such as sulfuric acid solutions, or aqueous alkaline solutions, such as sodium carbonate and/or bicarbonate.

Aqueous acidic solutions are normally quite effective in the extraction of uranium values. However, as detailed hereinafter, aqueous acidic solutions generally cannot be utilized to extract uranium values from ore or in-situ from deposits containing high concentrations of acid-consuming gangue, such as limestone. While some uranium in its hexavalent state is present in ores and subterranean deposits, the vast majority of the uranium is present in its valence states lower than the hexavalent state. For example, uranium minerals are generally present in the form of uraninite, a natural oxide of uranium in a variety of forms such as $UO_2$, $UO_3$, $UO.U_2O_3$ and mixed $U_3O_8$ ($UO_2.2UO_3$), the most prevalent variety of which is pitchblende containing about 55 to 75 percent of uranium as $UO_2$ and up to about 30 percent uranium as $UO_3$. Other forms in which uranium minerals are found include coffinite, carnotite, a hydrated vanadate of uranium and potassium having the formula $K_2(UO_2)_2(VO_4)_2.3H_2O$, and uranites which are mineral phosphates of uranium with copper or calcium, for example, uranite lime having the general formula $CaO.2UO_3.P_2O_5.8H_2O$. Consequently, in order to extract uranium values from subsurface formations with aqueous acidic leach solutions, it is necessary to oxidize the lower valence states of uranium to the soluble, hexavalent state.

Combinations of acids and oxidants which have been suggested by the prior art include nitric acid, hydrochloric acid or sulfuric acid, particularly sulfuric acid, in combination with air, oxygen, sodium chlorate, potassium permanganate, hydrogen peroxide and magnesium perchlorate and dioxide, as oxidants. However, the present invention is directed to the use of sulfuric acid leach solutions containing appropriate oxidants and other additives, such as catalysts.

In addition to the previously mentioned value of in-situ leaching of mineral values, where conventional mining of the ore is impossible or impractical, such leaching has numerous additional advantages. In-situ leaching eliminates the need for handling large tonnages of material, requires a minimum of surface installations and eliminates the need for disposing of final waste products, the last of which is particularly advantageous in the leaching of uranium. In addition, in more populated areas, in-situ leaching eliminates possible objections to undesirable open pits or structures. However, in-situ leaching is not without problems. Certain criteria must be met before an ore body may be considered suitable for in-situ leaching. Of particular importance are the characteristics of the surrounding strata. The ore should preferably be underlain by nonporous rock and should not be surrounded by badly fractured or channelled structures, any of which may lead to serious losses of leaching solution. Cement grouting or the use of special plastics or gels have been proposed as a means of sealing off possible areas of leakage. In addition, solution losses may be controlled to a certain extent by proper placement and usage of inlet and outlet wells.

Such placement of injection and production wells may be any of the patterns commonly utilized in enhanced recovery of oil from subsurface earth formations. For example, there are the usual "five-spot" patterns in which four injection wells are located at the corners of a square area and a single production well is located in the center of the square. Other similar patterns are also known. A particularly useful pattern for the recovery of mineral values is one in which the injection wells are located at the corners of a hexagonal area and a single larger production well is located in the center. Techniques for completing the wells, i.e., casing, cementing and perforating, etc., locating the wells, controlling the flow of fluids through the formation, preventing loss of fluid to thief formations, improving areal sweep, etc. are well known to those skilled in the art of in-situ recovery of mineral values and particularly to those skilled in the art of enhanced oil recovery and therefore, the details of such techniques need not be set forth herein.

In addition to the previously mentioned problems of injection, flow through and production from a subsurface formation, additional problems in the in-situ recovery of mineral values from subsurface formations result from the character of the mineral-containing formations themselves. This is particularly true when sulfuric acid leach solutions are utilized.

Certain gangue constituents and other minerals present in mineral-containing formations often have more influence over the process selection than do other factors. Such gangue materials or minerals include calcium carbonate, usually present as calcite or limestone formations, calcium, magnesium carbonate originating in dolomite formations and certain clays, such as montmorillonite clay, magnesium carbonate present as magnesite, ferric carbonate (usually occurring as a mixture of ferric carbonate, ferric hydroxide and ferrous hydroxide), ferrous and ferric sulfides and free iron, the iron compounds generally occurring in most types of subsurface formations in varying quantities. Among the problems resulting from the presence of these gangue or mineral materials are excessive consumption of leach chemicals, substantial increases in the time required to recover the mineral values, plugging of the subsurface formation by the formation of insoluble precipitates, particularly when utilizing sulfuric acid leach solutions, utilization of a significant portion of the capacity of ion exchange materials utilized for the recovery of mineral values from leach solutions, plugging of ion exchange agents (where solid ion exchange agents are utilized) and generally a detrimental effect on the exchange capacity of ion exchange agents and a slowing down of the ion exchange processes and other obvious problems. Since most of these problems result from the precipitation of these materials in aqueous solutions and the present invention is directed in one primary aspect to the prevention of such precipitation, these materials will be referred to herein as "precipitate-forming cations" or "cations which form precipitates with sulfuric acid".

Often the most troublesome precipitate-forming cation is calcium. The calcium usually in the form of calcium carbonate, calcium, magnesium carbonate etc. will consume acid from an acidic leach solution directly in a ratio of about one pound of sulfuric acid per pound of calcium carbonate that may be present in the subsurface formation. It is generally considered that calcium in amounts of about ten to fifteen percent can be tolerated by acidic leach solutions but if more than fifteen percent calcium carbonate is present, acid cost would be prohibitive. In addition to consuming large quantities of acid, calcium carbonate also results in the previously mentioned problem of precipitation and plugging of a subsurface earth formation during in-situ recovery. This is due to the fact that the reaction of sulfuric acid on calcium carbonate is to form calcium sulfate which has an extremely low solubility in water. Calcium sulfate is soluble in water up to about 2 grams per liter or 0.2% by weight of water, more specifically, less than 1.6 grams per liter or 0.16% by weight of water. Consequently, once a sulfuric acid leach solution contains this amount of calcium sulfate, any further reaction of the sulfuric acid with the calcium carbonate to form calcium sulfate results in the formation of solid precipates which tend to plug the formation and result in reducing the exchange capacity of ion exchange agents and the plugging of solid ion exchange agents. This is further complicated by the fact that, when leach solutions are normally flowed through the subsurface earth formation, the leach solution containing the mineral values is treated at the surface of the earth to remove the mineral values from the leach solution and the leach solution is therafter recycled one or more times through the formation to obtain optimum mineral value recovery. Accordingly, if the subsurface formation contains substantial amounts of calcium carbonate, the leach solution becomes saturated with calcium sulfate on the first pass through the formation and, therefore, during the second or subsequent passes through the formation, little further reaction of the sulfuric acid with the calcium carbonate is needed to cause the precipitation of calcium sulfate. Therefore, the only known technique in the prior art designed to overcome this problem, in the in-situ leaching of subsurface formations with sulfuric acid leach solutions, is to start with a sulfuric acid solution containing 1.0 to 1.5 grams of sulfuric acid per liter of leach solution or about 0.1 to 0.15 weight percent sulfuric acid in the leach solution. This leach solution is then circulated through the subsurface formation until all of the calcium carbonate has been reacted or neutralized, usually indicated by breakthrough or detection of acid in the leach solution produced from the producing well. Thereafter the concentration of acid in the leach solution is increased, for example, up to about 5 grams per liter or 0.5 weight percent. The obvious disadvantages of this technique include the large consumption of acid, as well as the increase in time necessary to carry out the process.

Another precipitate-forming cation which causes problems during the early stages of in-situ extraction of mineral values with aqueous acidic solutions is iron. While iron is not present in subsurface formations in the quantities in which calcium exists, it forms a wider variety of water-insoluble materials. Such water-insoluble materials include ferrous and ferric sulfates, ferric hydroxy sulfate, ferrous and ferric hydroxide, ferric oxide hydrate and possibly ferrous and ferric sulfides. Again these precipitates create the same problems as calcium precipitates, including formation plugging, plugging of solid ion exchange agents during surface treatment, reduction of the capacity of ion exchange agents, as well as difficulties involved in the separation of solubilized iron compounds from solubilized mineral values.

SUMMARY OF THE INVENTION

It is, therefore, an object of the present invention to provide and improved method for recovering mineral values from materials containing the same which overcomes the above-mentioned and other problems of the prior art. A further object of the present invention is to provide an improved method for recovering mineral values from subsurface earth formations containing the same by in-situ extraction. Another and further object of the present invention is to provide an improved method for the recovery of mineral values from subsurface earth formations containing the same wherein a leach solution adapted to solvate such mineral values is injected into the subsurface formation and the leach solution containing significant amounts of mineral values is then withdrawn. A still further object of the present invention is to provide an improved method for the in-situ leaching of mineral values from subsurface formations utilizing sulfuric acid leach solutions. Another and further object of the present invention is to provide an improved method for the in-situ leaching of mineral values from subsurface formations which prevents problems associated with the formation of precipitates by the action of sulfuric acid on precipitate-forming cations. A still further object of the present invention is to provide an improved method for the in-situ leaching of mineral values from subsurface formations which significantly reduces the time required for leaching. Yet another object of the present invention is to provide an improved method of in-situ leaching of mineral values from subsurface formations which results in improved recovery of mineral values and/or higher concentrations of mineral values in product concentrates. Another and further object of the present invention is to provide an improved method for the in-situ recovery of uranium from subsurface formations having any or all of the above-mentioned and objectives. These and other objects of the present invention will be apparent from the following description.

In accordance with the present invention, mineral values, particularly uranium, are recovered from subsurface earth formations containing the same, as well as cations which form precipitates with sulfuric acid leach solutions, by injecting, into at least one injection well, an acidic solution capable of forming soluble materials with at least one of the precipitate-forming cations, particularly calcium and iron cations, passing the acidic solution through the subsurface formation for time sufficient to form such soluble materials, withdrawing the acidic solution containing the solubilized precipitate-forming materials from at least one producing well, thereafter injecting a sulfuric acid leach solution into said injecting well, contacting the subsurface formation with the leach solution for a time sufficient to extract significant amounts of mineral values from the formation and produce a pregnant leach solution containing the thus solubilized mineral values and withdrawing the pregnant leach solution from the production well. In a preferred aspect, the acidic solution capable of forming soluble materials from precipitate-forming cations is selected from the group consisting of solutions of acetic acid, hydrochloric acid, citric acid, mixtures thereof, one or more of the same in sequence and one or more of the same and mixtures thereof in combination with sulfuric acid.

BRIEF DESCRIPTION OF THE DRAWING

The single FIGURE of the drawing is a schematic flow diagram of a system for the recovery of mineral values from a subsurface earth formation in accordance with the present invention.

DESCRIPTION OF THE PREFERRD EMBODIMENTS

The present invention will be best understood by the following description when read in conjunction with the drawing.

Referring specifically to the drawing, an injection well 10 and a production well 12 are drilled from the surface of the earth 14 into and through the mineral-containing formation 16. While only a single injection well and a single production well are shown in the drawing, it is to be understood that any number of injection and production wells may be utilized and such injection and production wells may be aereally oriented and spaced in conventional patterns or any other pattern adapted to attain optimum contact of the subsurface earth formation with the injected fluids. Likewise such injection and production wells will be drilled, completed and equipped in accordance with conventional practice known to those skilled in the art.

Fresh acid is introduced through line 18 and thence through line 20 to injection well 10. The fresh acid then passes through the mineral-containing formation 16 to production well 12 and is withdrawn through line 22. In accordance with one aspect of the present invention, the fresh acid referred to is an acid adapted to form soluble compounds and/or complexes with cations which normally form precipitates with sulfuric acid and, specifically, in accordance with this aspect of the present invention, calcium. Specific examples of such acids are acetic acid, hydrochloric acid and the like. The volume of the fresh acid utilized initially ranges from about 0.2 to about 20 pore volumes, preferably 0.5 to 5 pore volumes. Useful acid concentrations can range from 0.01 to 10% by weight and preferably 0.2 to 2.0 percent by weight. This fresh acid may also include sulfuric acid in amounts from 0 to 100%, preferably the sulfuric acid concentration should be below about 10% by weight, more preferably below about 0.16% by weight (solubility limit of calcium sulfate in water) and ideally 0%. Mixtures of acids capable of forming soluble compounds and/or complexes with calcium may also be utilized as can such mixtures in combination with sulfuric acid.

In accordance with another aspect of the present invention, the fresh acid is an acid capable of forming water-soluble compounds and/or complexes with iron. Citric acid is a preferred acid of this type, since it complexes with the iron both in the ferrous and ferric state and inhibits the formation of precipitates, such as those previously mentioned in the introductory portion hereof. The concentration of acid adapted to form soluble compounds and/or complexes with iron may generally be the same as those previously mentioned with respect to acids adapted to form soluble compounds and/or complexes with calcium. Likewise, the citric acid solution may contain sulfuric acid, as indicated previously.

In situations where both calcium and iron will create problems in the in-situ leaching with sulfuric acid, mixtures of acids capable of forming soluble compounds and/or complexes with calcium and acids capable of forming soluble compounds and/or complexes with iron are preferably utilized. Some acids capable of forming soluble compounds and/or complexes with calcium are also capable of forming soluble compounds and/or complexes with iron. Accordingly, such acid alone might be utilized. On the other hand, acetic acid may in some cases, form insoluble compounds with iron. In cases of this nature or where other factors dictate, it is preferable to sequentially inject the acids. For example, first a citric acid solution and, thereafter, an acetic acid solution. Other appropriate sequences can obviously also be used. In addition, any of the individual acids or mixtures or sequences of such acids may be combined with sulfuric acid, as indicated previously. The acid solution containing solubilized calcium and/or iron which is withdrawn from production well 12 through line 22, is then passed through line 24 to cation exchange unit 26. While a cation exchange unit is shown, any other technique for removing the solubilized, precipitatable materials from the acid solution may be utilized. Also, while cation exchange unit 26 may be a liquid cation exchange unit or one using a solid cation exchange agent, the latter is preferred and will be referred to hereinafter. At such time as the exchange capacity of the cation exchange agent in unit 26 is exhausted, for example, as indicated by breakthrough of calcium and/or iron ions, exchange unit 26 is removed from service and an eluent is introduced through line 28, passed through the cation exchange unit and spent eluent containing precipitatable materials is withdrawn through line 30. Where a liquid cation exchange material is utilized, this step is generally referred to as stripping, whereas in the case of a solid cation exchange material, it is referred to as elution. The prior art sometimes refers to this step as regeneration. However, this use will be avoided herein, since the cation exchange material often will become poisoned and the removal of such poisions is preferably referred to as regeneration. In any event, suitable stripping or eluent agents are well known in the art. For example, the eluent material may be sulfuric acid, introduced through line 32, thence through line 34 and finally through line 36. This sulfuric acid is preferably a very dilute solution of the same. Likewise a solution of sulfuric acid may be introduced through line 38 for the regeneration, i.e. removal of poisons from the cation exchange material. Eluent or regeneration solutions can obviously be further processed to remove precipitatable materials therefrom and reused if desired. The original acid which has been freed of a significant portion of the precipitatable materials, for example calcium and iron, is discharged from cation exchange unit 26 through line 40. In the event that very little or no mineral values, for example uranium, are present in the eluted acid passing through line 40, this acid may then be passed through line 42 to line 20 and reinjected into injection well 10. On the other hand, if the original acid solution contains significant amounts of uranium, this solution is then passed from line 40 to anion exchange unit 44 where the uranium is removed. Following removal of the uranium, the acid is discharged through line 46 and is reinjected through line 20. As was the case with cation exchange unit 26, when the ion exchange agent in anion exchange unit 44 reaches its capacity, it is taken off stream and the mineral values, specifically uranium, are removed therefrom by the introduction of a striper or an eluent through line 48. The eluent material, concentrated in mineral values, is discharged through line 50 for further processing in accordance with known practice. Suitable eluent materials are well known to those skilled in the art and include sulfuric acid, which may be introduced from line 32 through line 52 and thence through line 54. Other known eluent materials include nitrate and chloride solutions, for example, ammonium nitrate, nitric acid, sodium chloride in combination with sulfuric acid, ammonium chloride or sodium chloride in combination with hydrochloric acid or sulfuric acid, etc. Also, as was the case with the regeneration of the cation exchange agent, sulfuric acid may be introduced through line 56 for regeneration or the removal of poisons from the anion exchange agent. In the utilization of sulfuric acid as an eluent or a regenerating agent in either the cation exchange unit or the anion exchange unit, the sulfuric acid solution concentration is calculated so that the calcium and/or iron solubility is not exceeded. While a single cation exchange unit and a single anion exchange unit are shown in the drawings, it is to be understood that multiple units are preferably utilized, for example, one unit carrying out exchange, another being eluted and a third for standby or one being utilized for exchange, one being eluted, one being regenerated and a fourth as a standby. It is also possible in certain cases, as where the formation contains little, if any, calcium but significant amounts of iron to eliminate cation exchange unit 26 and utilize only anion exchange unit 44. In this case, the eluate from the anion exchange unit being discharged through line 50 will contain significantly greater amounts of iron mixed with the uranium. However, conventional processing downstream from this step can be employed successfully to separate the iron from the uranium.

As another alternative, where calcium is not present in the formation in amounts sufficient to create plugging problems, the calcium may be permitted to precipitate, as by using citric acid alone, which will precipitate the calcium as calcium citrate or a combination of citric acid and sulfuric acid which produce a calcium citrate and/or calcium sulfate precipitate. In this case, the cation exchange unit 26 would be bypassed by passing the solution through line 58. The solution then passes through line 40 and line 60 to a holding tank or pond 62 where the calcium precipitate is removed, as by settling or the like. The precipitate may be periodically withdrawn through line 64. The clarified solution then passes through line 66 where it is processed through anion exchange unit 44, as previously indicated.

In either of the last two cases, it is possible to utilize sulfuric acid in concentrations sufficient to extract mineral values, particularly uranium, from subsurface formation 16.

This preliminary treatment with acids capable of solubilizing precipitatable materials, such as calcium and iron, is repeated a sufficient number of times by cycling the same through injection well 10, formation 16, production well 12, cation exchange unit 26 and anion exchange unit 44 or anion exchange unit 44 alone until such time as the precipitatable materials are no longer present in amounts sufficient to cause problems. This will generally be indicated by the fact that the fluids produced through line 22 have the same pH as the injected fluids. At any time during this cycling or recycling fresh acid may be added as needed through line 18.

At the time that sufficient quantitities of precipitatable ions, such as calcium and iron, have been removed from the formation that little or no preliminary treating acid is consumed and there is no danger of the precipitation of the precipitatable materials, the preliminary treatment is discontinued.

The recovery of mineral values, particularly uranium, is then carried out in a conventional manner by the injection of sulfuric acid through line 68 or line 18, through line 20 and into injection well 10. The sulfuric acid solution at this point would be that conventionally utilized to leach mineral values, particularly uranium, from the subsurface formation. Obviously it can be above 0.16 wt. percent and may be as high as 20 percent by weight or preferably is in the neighborhood of about 0.5% by weight. The concentrated sulfuric acid then passes through formation 16, is produced from production well 12 and passed through line 22. Cation exchange unit 26 is unnecessary in this leaching operation and therefore the pregnant sulfuric acid leach solution is bypassed through line 58, thence through line 40 to anion exchange unit 44. The pregnant leach solution is then subjected to conventional anion exchange and the ion exchange material eluted in a conventional manner, using conventional eluents as previously mentioned. The concentrated sulfuric acid leach solution also necessarily includes an oxidant added through line 70 and may desirably also contain well known catalysts. The holding tank 62 may be used alternatively as previously described. This cycle may also be repeated any number of times necessary to extract the mineral values from the subsurface formation, adding fresh sulfuric acid and/or oxidant as needed.

The following calculated example will more specifically illustrate certain operations in accordance with the present invention.

If it is initially assumed that the subsurface reservoir has fluids of a pH 7.0 and is mineralized with uranium of a concentration of 0.4 wt. percent ($U_3O_8$) on the average. It is also assumed that permeability of the formation is 100 millidarcies, the porosity is 30% and the formation is bounded above and below by impermeable zones. The pore volume of the leaching solution is calculated as the product of the porosity times the volume of the formation being leached. Consequently, the initial charge of acid in the preliminary treatment will be about 3 pore volumes of 0.4 wt. percent acetic acid solution. Preferably no sulfuric acid is used in this preliminary stage. The pore volume of the formation is assumed to be large compared to the internal volume of the piping and various surface equipment so that the total volume of acid in the system, including the formation, will be 4 pore volumes. Therefore, the average or asymptotic steady state concentration of acetic acid will be 0.3 wt. percent. Cation exchange unit 26 is charged with a bead-type resin consisting of polysulfonated copolymer of styrene and divinylbenzene. The cation exchange resin has been previously treated with dilute sulfuric acid to convert all of the functional groups to the acid form. Ion monitors are attached to the wells to measure the pH of the injected and produced fluids. Additionally, ion monitors are placed before and after the cation exchange unit to indicate calcium and iron ions. The ion monitors can be any suitable means such as ion selective electrodes or atomic absorption spectroscopy instruments. The acetic acid is pumped into the injection well, through the formation and from the production well. Flow continues through the cation exchange unit and through the anion exchange unit, which is charged with a styrene divinylbenzene copolymer resin which has been fluoromethylated and treated with trimethylamine to convert the resin into a polyquaternary amine suitable for selectively removing uranyl complex anions, and finally the solution is pumped again into the injection well. This circulation is continued until breakthrough is observed in the cation exchange unit. Breakthrough in the cation exchange unit indicates that the capacity of the cation exchange resin for calcium and/or iron ions has been exhausted. At this point, pumping through the formation is stopped and the cation exchange unit is regenerated by washing with dilute sulfuric acid. However, as previously indicated, substantially continuous operation can be carried out be utilizing more than one cation exchange unit. The sulfuric acid solution concentration is calculated so that the calcium sulfate and iron (III) hydroxy-sulfate solubility products are not exceeded. Since the eluate from the elution of the cation exchange unit may contain small amounts of uranium, the eluate is passed through an anion exchange column (not shown) to remove the uranium as the uranyl sulfate complex. Pumping is resumed into the injection well, through the formation from the production well and through the two ion exchange units as before. The process can be repeated with multiple occasions of taking the cation exchange unit offstream to regenerate it until the produced fluids show the same pH as the injected fluids. In this case, sufficient quantities of calcium and iron ions will have been leached from the formation and little or no acetic acid is consumed in the process of pumping the fluids through the formation. At this point there is no danger of precipitation of calcium or iron solids in the formation. Therefore, further leaching for the recovery of uranium is accomplished by the injection of concentrated sulfuric acid. With suitable injection of sulfuric acid and oxidant, by known techniques, the formation can be leached essentially completely of uranium content. During the sulfuric acid leaching stage, there is no need to have cation exchange unit 26 in the flow path. Therefore, as indicated in the drawing, it is bypassed.

As previously indicated, the above example will also be applicable to the utilization of hydrochloric acid instead of acetic acid, or alternatively, a mixture of hydrochloric acid and acetic acid.

The same example would also be applicable where citric acid is substituted for acetic acid or a mixture of citric acid and acetic acid is utilized.

In any of the above examples, sulfuric acid may be added to the other acids individually or mixtures thereof. However, in this case, care should be taken not to exceed the solubility limits of the precipitatable materials.

In another example, it is assumed that the reservoir fluids have a pH of 7.0 and are mineralized with uranium of a concentration of 0.4 wt. percent ($U_3O_8$) on the average. Gangue mineralization is assumed to be predominantly as leachable iron minerals and little, if any, leachable calcium minerals. As in the previous example, it is assumed the formation has a permeability of 100 millidarcies, a porosity of 30% and is bounded above and below by impermeable zones. The general flow scheme will be the same as that previously described and shown in the drawing. Also, as in the previous example, the pore volume of the leaching zone is calculated as the product of porosity times the volume of the formation being leached. The initial charge of acid is 3 pore volumes of a mixture consisting of 0.3 wt. percent sulfuric acid and 0.1 wt. percent citric acid. As in the previous example, the pore volume of the formation is assumed to be large compared to the internal volume of the piping and surface equipment. Consequently, the total acid in the system is 4 pore volumes. Therefore, the average or asymptotic steady state concentration of sulfuric acid will be 0.225 wt. percent and of citric acid will be 0.075 wt. percent. The acid mixture is pumped into the injection well, through the formation and from the injection well. Flow continues through the anion exchange unit, which is charged with styrene divinylbenzene copolymer resin, which has been chloromethylated and treated with trimethylamine to convert the resin into a polyquaternary amine suitable for selectively removing uranyl complex anions, and, finally, the solution is pumped again into the injection well. Prior to the anion exchange unit, additional sulfuric acid can be added to maintain the injection fluid pH. As the acid solution passes through the anion exchange unit, uranium complexed as the uranyl sulfate complex anion and iron complexed as the ferrous and ferric citrate complex anions will be extracted from the solution. As these anions approach the capacity of the anion exchange unit, breakthrough will be approached and it will be necessary to take the anion exchange unit off line and elute the same conventionally. The eluate from the elution cycle will contain substantially more iron mixed with the uranium than is the case in conventional processing. However, processing downstream from this step can be employed successfully to separate the iron from the uranium.

While specific materials, items of equipment and modes of operation are set forth above, it is to be understood that these specific recitals are by way of example and to set forth the best mode of operation in accordance with the present invention and are not to be considered limiting and that various modifications, equivalents and variations will be apparent to one skilled in the art without departing from the present invention.

That which is claimed:

1. A method for the recovery of uranium from a subsurface earth formation containing uranium and iron in a form which reacts with sulfuric acid to form precipitates, comprising:

(a) injecting into at least one injection well an aqueous acidic treating agent including an aqueous solution of citric acid in a concentration sufficient to solubilize a significant amount of iron;

(b) passing said aqueous acidic treating agent through said subsurface formation for a time and under conditions sufficient to solubilize a significant amount of iron;

(c) withdrawing said aqueous acidic treating agent containing the thus solubilized iron from at least one production well;

(d) passing the thus withdrawn aqueous acidic treating agent containing said solubilized iron through a cation exchange material to remove said solubilized iron from said aqueous acidic treating agent and produce a reuseable aqueous acidic treating agent;

(e) repeating steps (a) through (d) at least once with said reuseable aqueous acidic treating agent;

(f) thereafter injecting a sulfuric acid leach solution, adapted to extract significant amounts of uranium from said subsurface formation, into said injection well;

(g) contacting said subsurface formation with said sulfuric acid leach solution under conditions and for a time sufficient to extract significant amounts of uranium from said subsurface formation and produce a pregnant leach solution containing the thus solubilized uranium; and (h) withdrawing said pregnant leach solution from said production well.

2. A method in accordance with claim 1 wherein the subsurface formation also contains calcium in a form which reacts with sulfuric acid to form precipitates and the aqueous solution of citric acid additionally contains hydrochloric acid in a concentration sufficient to solubilize a significant amount of calcium.

3. A method in accordance with claim 1 wherein the subsurface formation additionally contains calcium in a form which reacts with sulfuric acid to form precipitates and the aqueous acidic treating agent includes the aqueous solution of citric acid followed by an aqueous solution of an acid selected from the group consisting of acetic acid and hydrochloric acid, in a concentration sufficient to solubilize significant amounts of calcium.

4. A method in accordance with claim 1 wherein the aqueous acid treating agent thus withdrawn from the production well additionally contains solubilized uranium and the reusable aqueous acidic treating agent is passed through an anion exchange material to remove said solubilized uranium prior to carrying out step (e).

* * * * *